US005630985A

United States Patent [19]

Williams et al.

[11] Patent Number: 5,630,985

[45] Date of Patent: May 20, 1997

[54] CHEMICAL AGENTS AND METHOD FOR THE INHIBITION OF CORROSION AND DEPOSIT FORMATION IN WATER SYSTEMS

[75] Inventors: Dennis C. Williams, Upchurch; Christopher P. Rycroft, Rainham, both of England

[73] Assignee: Buckman Laboratories International, Inc., Memphis, Tenn.

[21] Appl. No.: 302,925

[22] PCT Filed: Jan. 22, 1993

[86] PCT No.: PCT/GB93/00139

§ 371 Date: Jan. 4, 1995

§ 102(e) Date: Jan. 4, 1995

[87] PCT Pub. No.: WO94/17221

PCT Pub. Date: Aug. 4, 1994

[51] Int. Cl.[6] ..... C23F 11/12

[52] U.S. Cl. ..... 422/17; 422/14; 252/395; 252/396

[58] Field of Search ..... 422/14, 17; 252/395, 252/396; 210/701

[56] References Cited

U.S. PATENT DOCUMENTS

| | | | |
|---|---|---|---|
| 4,240,925 | 12/1980 | Tait | 422/15 |
| 4,324,676 | 4/1982 | Gilbert | 422/14 |
| 4,389,371 | 6/1983 | Wilson et al. | 422/14 |
| 4,798,675 | 1/1989 | Lipinski et al. . | |
| 5,248,438 | 9/1993 | Perez | 422/17 |

*Primary Examiner*—Timothy McMahon

*Attorney, Agent, or Firm*—Finnegan, Henderson, Farabow, Garrett & Dunner, L.L.P.

[57] ABSTRACT

A chemical formulation and method are provided for the treatment of water to prevent, control or inhibit corrosion and/or deposits, particularly for the treatment of water in water distribution piping and equipment and associated heat exchangers and more particularly for the treatment of water in heat transfer equipment wherein water or steam is employed as the heat transfer medium. The method treats the water with at least one mono- or polyhydric alcohol. Optionally, the treatment formulation is a blend of mono- or polyhydric alcohols and further optionally includes one or more of a mixed molecular weight polyacrylic acid and/or at least one salt thereof; at least one chromium-free lignosulfonate, and at least one carboxylic acid and/or at least one salt thereof, the carboxylic acid being different from the poly acrylic acid.

22 Claims, No Drawings

CHEMICAL AGENTS AND METHOD FOR THE INHIBITION OF CORROSION AND DEPOSIT FORMATION IN WATER SYSTEMS

This invention relates to a (1) chemical formulation useful for treating water to inhibit corrosion and/or deposit formation, particularly useful to inhibit, prevent or control corrosion and/or deposit formation in water distribution piping and equipment and associated heat exchangers and also particularly useful for the prevention, control or inhibition of corrosion and of deposits in heat transfer equipment wherein water or steam is employed as a heat transfer medium and (2) process for using such chemical formulation. In a specific embodiment, the invention relates to the application of the formulation and process in cases where geothermal hot water and steam are used as the heat transfer medium.

A number of examples can be cited of industrial and other applications in which ground water (i.e., well water is employed as a heat transfer medium. For example, in some areas of the world, geothermal hot water and steam are available at underground depths such that they can be economically captured. In such areas, present day prices and pollution concerns associated with the use of fossil fuels make it practical to use geothermal heat to drive equipment such as electrical generation equipment.

Geothermal heat is increasingly being used for this purpose. Geothermal heat can also be used to provide hot utility water for other applications such as heating buildings or for driving chemical processes.

A typical "geothermic circuit" consists of a production well drilled into a suitable porous rock formation or aquifer no a depth sufficient to provide the required volume of water. The depth can vary considerably depending on the geological configuration of the surrounding strata. The well is usually provided with a submersible production pump, although in some cases, the water or steam pressure within the well is sufficient to force the water to the surface. At the surface, the geothermal hot water and/or steam is passed through one or a series of heat exchangers to produce hot utility water or steam for, by way of example, turbine powered electricity generation. After passing through the heat exchanger(s), the water is returned to the ground via a waste well drilled to a predetermined appropriate depth, thus completing the circuit.

Well water is also increasingly being employed as a heat transfer medium for air conditioning/heat pump systems. The same basic geothermal circuit is employed as that described in the preceding paragraph except that hot water is not employed.

A serious problem involved with the use of ground water as a heat exchange medium is that ground water is almost always high in mineral content which frequently leads to corrosion of the water distribution piping and heat exchangers. Such corrosion reduces the useful life of the system. Another serious problem is the formation of scale deposits in the system which also reduce the useful life and the efficiency of the systems by clogging the distribution pipes and the heat exchangers.

In general, particularly when geothermal hot water and/or steam is used, there are three principal problems, to wit:

a. the deposition of sulfur-containing iron deposit is on metal surfaces due to the direct attack by $H_2S$ dissolved in the geothermal water or by naturally high sulfurous iron levels in the water;

b. high corrosion rates of the metal surfaces due to direct $H_2S$ attack; and c. deposition of various types of scale on the metal surfaces due to chemistry of the particular geothermal water being used.

The problems associated with the use of ground water are also encountered to a lesser or, sometimes, greater extent, depending upon the geographic area, with surface water, e.g., river water.

Prior art methods of controlling, preventing or inhibiting corrosion and scale deposition in water distribution equipment and associated heat exchangers, while reasonably effective in some cases, also have been less than optimal in some cases.

One known method has been to add a mixture of certain acrylates and phosphonates to the geothermal water. It has also been suggested to protect the metal surfaces by use of a film-forming amine-type product. While these techniques have proven fairly successful in some highly corrosive systems, it is still desirable to find other techniques which are more nearly optimal.

It is an object of this invention to provide a formulation of chemical agents for the control, prevention and inhibition of corrosion and deposits experienced in water and steam distribution piping and equipment and associated heat exchangers using water as the heat transfer medium.

BRIEF DESCRIPTION OF THE INVENTION according to this invention, a process of treating water to inhibit corrosion and/or deposit formation comprises adding to said water for the purpose of inhibiting said corrosion and/or deposit formation an effective amount of at least one mono- or polyhydric alcohol, preferably of a blend of at least two mono- or polyhydric alcohols. The process of the invention can further comprise adding to the water one or more of: a mixed molecular weight poly(acrylic acid) and/or at least one salt thereof; a chromium free lignosulfonate; and at least one carboxylic acid and/or at least one salt thereof, the carboxylic acid being different from the the poly(acrylic acid). The invention further comprises a chemical formulation which comprises:

a. at least one mono- or polyhydric alcohol, preferably a blend of at least two mono- or polyhydric alcohols;

b. a mixed molecular weight poly(acrylic acid) and/or at least one salt thereof; and c. at least one chromium-free lignosulfonate, wherein compounds a–c are present in a combined amount effective to treat water to inhibit corrosion and/or deposit formation. The chemical formulation of the invention can further comprise at least one carboxylic acid and/or at least one salt thereof, the carboxylic acid being different from the poly(acrylic acid). The carboxylic acid and/or salt thereof can be added to the formulation to decrease the pH thereof to not greater than 7.0. The formulation of the invention can, optionally, also include sodium, ammonium or potassium metabisulfites, ascorbic acid or salt thereof, and or an N, N-di (lower alkyl)amide of a straight chain carboxy acid.

DETAILED DESCRIPTION OF THE INVENTION

The effective ingredients in the formulation and process according to this invention can be mixed in a wide range of weight ratios. For optimum results, a mixture of mono- and polyhydric alcohols will predominate. Preferred formulations are within the following limits:

| COMPONENT | BROAD RANGE | PREFERRED | MOST PREFERRED |
|---|---|---|---|
| Alcohols | 50–100% | 60–97% | 80–97% |
| PAA | 0–50% | 1–38% | 1–28% |
| Carboxylic Acid | 0–12% | 0–5% | 1–5% |
| Lignosulfonate | 0–50% | 1–38% | 1–18% |

The blend of mono- and polyhydric alcohols preferably comprises predominantly, i.e., greater than 50%, polyhydric alcohols. The polyhydric alcohols can be of low to moderate molecular weight from about 62 to 496. Typical of such alcohols are ethylene glycol, propylene glycol, tripropylene glycol, propane-1,2-diol, tetramethylene glycol, butane-1,4-diol, butane-1,2-diol, butane-2,3-diol, glycerine, polyglycerine, isoamylene glycol, pinacol, 1-methylglycerine, 1,2,4-butanetriol, 1,2-pentanediol, 1,4-pentanediol, pentamethylene glycol, 1,2,3-pentane triol and also polyglycols such as, for example, poly(ethylene glycol) and poly(propylene glycol). Preferred are the triols and a particularly preferred triol is glycerine Also preferred polyglycerine having an average carbon number of 13–14.

The monohydric alcohols can be those having a molecular weight between about 34 and 142. Typical of such alcohols are ethanol, propanol, n-butanol, isobutanol t-butanol, pentanol hexanol, benzyl alcohol, and he $C_7$ and $C_8$ alcohols.

Mixed molecular weight polyacrylic acids (PAA) and their sales that can be usable in the process of this invention are water soluble oligomers and low molecular weight polymers. They are available in a wide range of molecular weights and molecular weight distributions. Preferred PAA's are those having average molecular weight less than about 8,000 and a relatively broad molecular weight distribution. Such materials are available commercially, e.g., under the trade names Plexisol by Huls and Paraloid and Acrysol 20 by Rohm & Haas.

The carboxylic acids can be relatively low to moderate molecular weight acids that are water soluble. The carboxylic acid or salt thereof is generally added to regulate the pH to a neutral or acidic, preferably slightly acidic, level, countering the normal basicity of some of the polyhydric alcohols. Examples of the acids that can be employed are acetic, propionic, butyric, citric, itaconic, maleic and succinic acids.

The chromium free lignosulfonates are commercially available materials. Any chromium-free lignosulfonate can be used. Typical materials are commercially available under the tradenames Borrosperse made by Borregaard, Norway an Maracel by Marathon Chemical Co.

For best results, at least about 1.0 and more preferably by least about 1.5 pares of the formulation per million parts ppm) of water are used. So far as getting results is concerned, there is no upper limit to the amount of the formulation that can be used. However, for reasons of economy, one would normally not want to use greater than about 200 to 300 ppm. Amounts greater than this would, in most cases, simply be wasted.

The components of the formulation are usually dissolved in a suitable solvent, preferably water, for adding to the water to be treated. The concentration of the formulation in the water is not critical, but it is preferred that the concentration be such that the viscosity of the solution is low enough that it can be easily handled for injection into the water. A concentration up to about 25% by weight in water can yield a readily pumpable viscosity and facilitates charging small quantities of the effective components.

The injection point for the formulation can be any point from the bottom of the well to the ground surface. The precise point of introduction will normally be based on convenience, but optimally will be at a point where contact between untreated water and the steel of the well casing is kept to a minimum. Thus, the preferred point of addition is at the lower end of the well casing. In most cases, however, introduction of the formulation will be effected at the surface level where introduction is a much simpler operation. Conventional liquid feeding equipment is employed.

The process and formulations according to this invention are advantageous as they do not pose any environmental problems. Formulations according to this invention are biodegradable to simple harmless products which, when returned to earth via the waste well, cause no harmful pollution of the ground water.

In addition to the components of the formulations set forth above, an anionic surfactant can also be added to stabilize the formulation prior to use and to facilitate dispersion of the formulation when it is added to the water to be treated. Typical anionic surfactants include sodium linear alky sulfonates, such as Tergitol sulfonate (Union Carbide) and Triton X100 sulfonate (Roban & Haas).

For specific applications, depending on the chemistry of the available ground water, other components can be incorporated into the formulations as is known in the art. Examples of such additional components are ascorbic acid, N,N-dialkylamides of linear fatty acids and ammonium, sodium or potassium metabisulfites. Ascorbic acid is useful when oxygen concentration in groundwater exceeds 1 ppm. The dialkyl amides are useful when the groundwater may be polluted by hydrocarbons. The metabisilfites are useful when oxygen levels in groundwater exceed 1 ppm. These additional components should be used only in minor amounts. Normally, 10 to 200 ppm by weight, based on the weight of water being treated, should be used.

The following example shows an application of the formulation and method of the invention. It should be understood than the invention is non intended to be limited to the specific embodiment exemplified herein.

EXAMPLE

A composition according to the invention was applied to treatment of water in a geothermal circuit employed to produce steam for electricity generation in Central Europe. The geothermal well was located about 2 kilometers from the location where the heat exchangers were installed. The pipeline from the well to the heat exchangers had a diameter of 50 centimeters and the system was capable of carrying up to 400 cubic meters of water per hour. The well was equipped with an appropriately sized submersible pump located in a pool of geothermal hot water at about 110 meters below ground level.

Analysis of the water from this well indicated that it was relatively high in corrosive components containing at least the mineral matter shown in the following table:

| Cations | ppm | mmol/liter | Anions | ppm | mmol/liter |
|---|---|---|---|---|---|
| $Na^+$ | 10050 | 436.957 | $HCO_3^-$ | 312 | 5.115 |
| $K^+$ | 128 | 3.274 | $Cl^-$ | 10560 | 523.554 |
| $Ca^{++}$ | 1720 | 43.000 | $SO_4^{--}$ | 1020 | 10.625 |
| $Mg^{++}$ | 357 | 14.691 | $HS^-$ | 15.6 | 0.473 |

The amount of corrosion caused by this water was measured by installing a Corrator probe in the line at the outlet of one of the heat exchangers. In addition, corrosion coupons were installed in the pipeline at the surface level near the point where the treatment formulation was introduced.

With the pumps delivering approximately 260 cubic meters per hour of geothermal hot water, the following formulation was introduced into the pipeline at ground level and at a rate of 10 grams/cubic meter (10 ppm) of water flowing through the system:

| | |
|---|---|
| Polyglycerine (average carbon number if 13–14) | 40% |
| Tripropyleneglycol | 10% |
| Mixed PAA[1] | 21% |
| Chrome-free lignosulfonates | 4% |
| Dilute Citric acid in $H_2O$ to bring pH to 8.5 | 25% |

[1]The mixed PAA used here is the Rohm & Haas product Acrysol 20.

After 24 hours, the feed rate of the formulation was decreased to about 2.5 grams/cubic meter.

Corrator probe readings were taken periodically over a period of one month which indicated a corrosion rate of about 0.01 microns of corrosion per year. At this point the dosage rate was decreased to 1.5 grams/cubic meter and the test was continued for an additional two weeks. Corrator probe readings remained constant at 0.01 micron/year over the entire time period.

At the end of the six week test period, the corrosion coupons were removed and inspected. Weight loss indicated the corrosion rate to be about 0.05 mm/year.

We claim:

1. A process of treating water to inhibit corrosion and/or deposit formation which process comprises adding to said water for the purpose of inhibiting said corrosion and/or deposit formation an effective amount of at least one mono or polyhydric alcohol wherein said monohydric alcohol has a molecular weight of from about 34 to about 142 and said polyhydric alcohol has a molecular weight of from 62 to about 496.

2. A process according to claim 1, wherein an effective amount of a blend of at least two mono- or polyhydric alcohols is added.

3. A process according to claim 2, wherein the blend is a blend of polyglycerine and tripropylene glycol.

4. A process according to claim 2, further comprising adding to said water a mixed molecular weight poly(acrylic acid) and/or at least one salt thereof.

5. A process according to claim 4, further comprising adding to said water a chromium free lignosulfonate.

6. A process according to claim 5, further comprising adding to said water at least one carboxylic acid and/or at least one salt thereof, said carboxylic acid being different from said poly(acrylic acid).

7. A process according to claim 2, further comprising adding to said water a chromium free lignosulfonate.

8. A process according to claim 7, further comprising adding to said water at least one carboxylic acid and or at least one sale thereof.

9. A process according to claim 2, further comprising adding to said water at least one carboxylic acid and/or at least one sale thereof.

10. A process according to claim 9, further comprising adding to said water a mixed molecular weight poly(acrylic acid) and/or an lease one salt thereof, said poly(acrylic acid) being different from said carboxylic acid.

11. A process according to claim 2, wherein to said water is added a formulation comprising 50 to 100% by weight of said blend of said mono- or polyhdric alcohols; 0 to 50% by weight of mixed molecular weight poly(acrylic acid) and/or at least one salt thereof; 0 to 50% by weight of chromium free lignosulfonate; and 0 to 5% by weight of at least one carboxylic, acid and/or at lease one salt thereof, said carboxylic acid being different from said poly(acrylic acid).

12. A process according to claim 11, wherein to said water is added a formulation comprising 60 to 97% by weight of said blend of said mono- or polyhydric alcohols, 1 to 38% by weight of said mixed molecular weight poly(acrylic acid) and/or at least one salt thereof; 1 to 38% by weight of said chromium free lignosulfonate, and 0 to 5% by weight of said at least one carboxylic acid and/or at lease one salt thereof.

13. A process according to claim 12, wherein said formulation comprises 80 to 97% by weight of said blend of said mono- or polyhydric alcohols, 1 to 28% by weight of said mixed molecular weight poly(acrylic acid) and/or at least one salt thereof; 1 to 18% by weight of said chromium free lignosulfonate, and 1 to 5% by weight of said at least one carboxylic acid and/or at least one salt thereof.

14. A chemical formulation which comprises:

a. at least one mono- or polyhydric alcohol;

b. a mixed molecular weight poly(acrylic acid) and/or at least one salt thereof; and c. at least one chromium-free lignosulfonate, wherein compounds a–c are present in a combined amount effective to treat water to inhibit corrosion and/or deposit formation, and wherein said monohydric alcohol has a molecular weight of from about 34 to about 142 and said polyhydric alcohol has a molecular weight of from 62 to about 496.

15. A chemical formulation according to claim 14, wherein said formulation comprises a blend of at least two mono- or polyhydric alcohols.

16. A chemical formulation according to claim 15, wherein said formulation further comprises at least one carboxylic acid and/or at least one salt thereof, said carboxylic acid being different from said poly(acrylic acid).

17. A chemical formulation according to claim 16, wherein said least one carboxylic acid and/or at least one salt thereof is present in an amount effective to decrease the pH of the formulation to not greater than 7.0.

18. A chemical formulation according to claim 17, wherein said at least one carboxylic acid and/or at least one salt thereof is present in an amount effective to decrease the pH of the formulation to 7.0.

19. A chemical formulation according to claim 15, wherein said blend of mono- or polyhydric alcohols is 60 to 97% by weight, said mixed molecular weight poly(acrylic acid) or salt thereof is 38% by weight, and said chromium-free lignosulfonate is 1 to 38% by weight.

20. A chemical formulation according to claim 19 wherein said formulation further comprises up to 12% of at least one carboxylic acid and/or at least one salt hereof, said carboxylic acid being different from said poly(acrylic acid).

21. A chemical formulation according to claim 20, wherein said blend of mono- and polyhydric alcohols is 80 to 97% by weight, said mixed molecular weight poly(acrylic acid) or sale thereof is 1 to 18% by weight, said one or more carboxylic acid or salts thereof is 1 to 12% by weight, and said chromium free lignosulfonate is 1 to 28% by weight.

22. A process of treating water to inhibit corrosion and/or deposit formation which process comprises adding to said water for the purpose of inhibiting said corrosion and/or deposit formation an effective amount of a composition consisting essentially of at least one mono- or polyhydric alcohol.

* * * * *

UNITED STATES PATENT AND TRADEMARK OFFICE

CERTIFICATE OF CORRECTION

PATENT NO.: 5,630,985
DATED : May 20, 1997
INVENTOR(S): Dennis C. Williams et al.

It is certified that error appears in the above-identified patent and that said Letters Patent is hereby corrected as shown below:

In column 5, line 57, claim 8, "sale" should read --salt--;

line 60, claim 9, "sale" should read --salt--;

line 63, claim 10 "an lease" should read --at least--;

line 67, claim 11, "polyhdric" should read --polyhydric--.

In column 6, line 4, claim 11, "lease" should read --least--;

line 12, claim 12, "lease" should read --least--;

line 57, claim 21, "sale" should read --salt--.

Signed and Sealed this

Twenty-first Day of October 1997

*Attest:*

Bruce Lehman

BRUCE LEHMAN

*Attesting Officer*

*Commissioner of Patents and Trademarks*